US008328592B2

(12) United States Patent
Cynamon

(10) Patent No.: US 8,328,592 B2
(45) Date of Patent: Dec. 11, 2012

(54) FLOTATION DEVICE FOR RESCUE APPARATUS AND METHOD OF USE

(76) Inventor: Sam Cynamon, Milburn, NJ (US)

( * ) Notice: Subject to any disclaimer, the term of this patent is extended or adjusted under 35 U.S.C. 154(b) by 396 days.

(21) Appl. No.: 12/724,576

(22) Filed: Mar. 16, 2010

(65) Prior Publication Data

US 2010/0233922 A1 Sep. 16, 2010

Related U.S. Application Data

(60) Provisional application No. 61/210,204, filed on Mar. 16, 2009.

(51) Int. Cl.
*B63C 9/00* (2006.01)

(52) U.S. Cl. ..... 441/40; 441/80

(58) Field of Classification Search ..... 441/40, 441/41, 80

See application file for complete search history.

(56) References Cited

U.S. PATENT DOCUMENTS

| | | | | |
|---|---|---|---|---|
| 4,464,132 | A * | 8/1984 | Mauck | 441/81 |
| 4,466,145 | A * | 8/1984 | Jones et al. | 5/625 |
| 5,179,746 | A * | 1/1993 | Rogers | 5/625 |
| 5,306,026 | A * | 4/1994 | Jesse | 280/18 |
| 5,687,664 | A * | 11/1997 | Sofian | 114/61.25 |
| 2007/0077126 | A1* | 4/2007 | Garcia et al. | 405/186 |
| 2007/0216118 | A1* | 9/2007 | Jackson et al. | 280/47.131 |

FOREIGN PATENT DOCUMENTS

| | | | |
|---|---|---|---|
| JP | 07-040396 | U | 7/1995 |
| JP | 2003-002286 | A | 1/2003 |
| JP | 2003-095185 | A | 4/2003 |
| JP | 2005-075324 | A | 3/2005 |

OTHER PUBLICATIONS

International Search Report mailed Oct. 13, 2010 issued by the International Searching Authority in related International Application No. PCT/US2010/027462 (3 pages).

Written Opinion mailed Oct. 13, 2010 issued by the International Searching Authority in related International Application No. PCT/US2010/027462 (4 pages).

* cited by examiner

*Primary Examiner* — Stephen Avila

(74) *Attorney, Agent, or Firm* — Robert P. Michal; Lucas & Mercanti, LLP

(57) ABSTRACT

Flotation device for rescue apparatus includes a support portion onto which an injured person is placed, and a buoyant structure connected to the support portion to provide buoyancy for the support portion. The buoyant structure includes one or more fluid containers each attached to the support portion by, for example, straps. At least one pressure regulating mechanism is integrated into or onto a surface of each container and functions to vary pressure of fluid in the hollow space of the container, and may include inflation mechanisms that enable controlled inflow of fluid into the hollow space of the containers, and deflation or pressure release mechanisms that enable controlled outflow of fluid from the hollow space of the containers,

15 Claims, 3 Drawing Sheets

FLOTATION DEVICE FOR RESCUE APPARATUS AND METHOD OF USE

CROSS REFERENCE TO RELATED APPLICATION

This application claims priority under 35 U.S.C. §119 of U.S. provisional patent application Ser. No. 61/210,204 filed Mar. 16, 2009, the disclosure of which is incorporated by reference herein.

FIELD OF THE INVENTION

The present invention relates generally to an aquatic safety device and more particularly to a device for use in stabilizing a potentially injured person in a body of water and enabling transport of the person from the body of water to dry land while in a stabilized state, and possible further transport of the person as needed.

The present invention also relates to a method for stabilizing a person in a body of water and enabling transport of the person from the body of water to dry land while in a stabilized state, and which also enables further transporting of the person as needed.

BACKGROUND OF THE INVENTION

All nationally recognized organizations, including the American Red Cross, the Young Men's Christian Association (YMCA), the Starguard Program, place a high priority on the quick, efficient and safe handling of potential neck, back and spinal cord injuries in the aquatic environment, whether in a swimming pool or other body of water in which people are recreating.

A primary technique to handle potential neck, back and spinal cord injuries in general is backboarding, wherein the injured person is placed onto a substantially flat board as soon as possible after being identified as having a possible neck, back or spinal cord injury. The objective of backboarding an injured person is to enable the person's head, neck and back to be placed into an in-line stabilization position, i.e., in line with one another, and thereby maintain an open airway to facilitate the person's breathing. Moreover, by virtue of a specific construction, most backboards facilitate easier transport of the injured person, e.g., from a field of play onto a vehicle for transport to a medical facility.

In the aquatic environment, training lifeguards to handle dangerous situations involving injured people and quickly backboarding an injured person is an ongoing process that requires additional equipment and personnel in order to safely manage the variables that can positively or negatively affect the injured person's prognosis. These variables include, but are not limited to, the size and condition of the patient, the depth of the water that the injured person is located in, additional water conditions such as temperature, movement and surface conditions, the number of lifeguards on duty, the type of equipment available to handle the specific potential injury, and the amount of practice, training and experience the lifeguards have handling the specific potential injury.

To date, there is not believed to be any product specifically designed to address such emergencies in consideration of the relatively large number of variables that affect the use of a backboard or other type of rescue apparatus in the aquatic environment.

SUMMARY OF THE INVENTION

A flotation device in accordance with the invention addresses the need to stabilize an injured person in aquatic environment in consideration of variables that affect the use of rescue apparatus in the aquatic environment, and includes a buoyant structure connectable to a support portion of the rescue apparatus onto which an injured person is placed, and provides buoyancy to the support portion. The buoyant structure defines at least one container having a hollow, fluid-fillable space. Straps or another attachment system removably or permanently attach each fluid container to the support portion. One removable attachment system includes straps that each extend through a hand-hold or other aperture in the support portion and through a grommet on the buoyant structure. Another removable attachment system includes straps that each extend around a fluid container and through a hand hold or other aperture in the support portion. By means of this attachment, the buoyancy of the fluid container(s) is applied to the support portion onto which the injured person is placed.

When the rescue apparatus is a backboard, the support portion would be a backboard portion thereof.

The flotation device advantageously enables a variable buoyancy force to be provided and thereby be responsive to variables that affect the use of a backboard or other rescue apparatus in the aquatic environment, by including at least one pressure regulating mechanism integrated into or onto a surface of each fluid container and which each function to vary pressure of fluid in a hollow interior space of the fluid container. Exemplifying pressure regulating mechanisms include various inflation mechanisms that each enable controlled inflow of fluid into the hollow space of the fluid container, such as a manual inflation valve including an inflation tube and a pressurized gas cartridge and associated activatable releasing mechanism, and manually or automatically activated deflation or pressure release mechanisms, such as a dump valve, that each enable manually controlled or automatically controlled outflow of fluid from the hollow space of the fluid container.

In use to stabilize an injured person in an aquatic environment, the flotation device is readied for use by connecting the buoyant structure to the support portion, the injured person in the body of water is placed onto the support portion, and fluid is directed into the hollow space of each container until the buoyant structure is capable of providing buoyancy for the injured person when placed onto the support portion. Fluid may be directed into the container(s) before, during and/or after the injured person is placed onto the support portion. Then, the pressure of the fluid in the hollow space of each container, i.e., the buoyancy force, is preferably adjusted relative to, for example, a size of the injured person and/or conditions of the aquatic environment to thereby optimize the buoyancy of the flotation device and facilitate an easier stabilization of the injured person in consideration of the stabilization conditions then existing.

The invention may be the buoyant structure itself and its adaptation to be connected to a support portion of rescue apparatus, such as an existing backboard, the manner of use of the buoyant structure in combination with an existing backboard or other rescue apparatus, or a combination of the buoyant structure and a backboard or other rescue apparatus.

BRIEF DESCRIPTION OF THE DRAWINGS

The invention may best be understood by reference to the following detailed description of and illustrative embodiment when read in conjunction with the accompanying drawings, wherein.

DETAILED DESCRIPTION OF THE INVENTION

Figure 1:
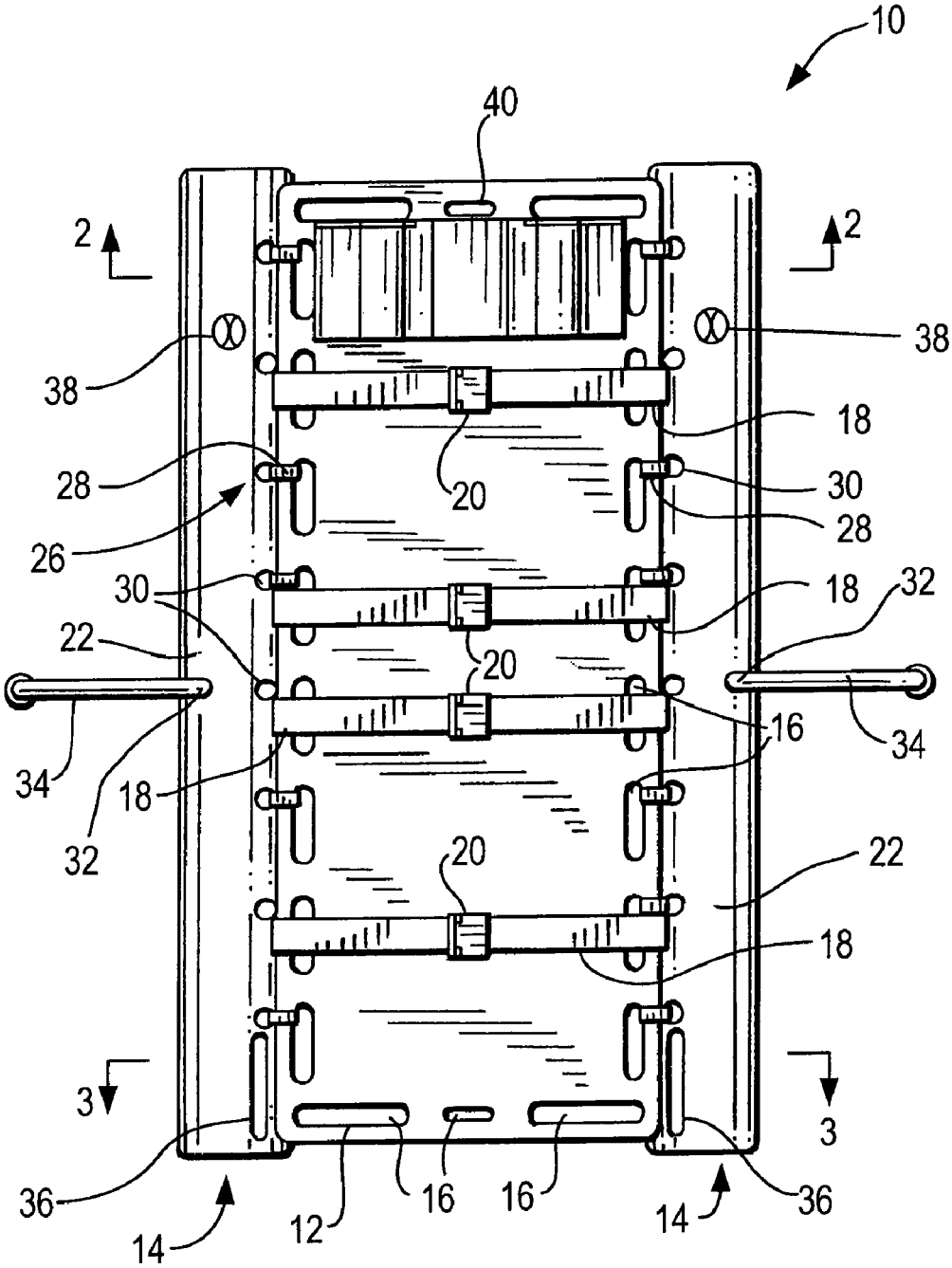
FIG. 1 is a top view of a first embodiment of a flotation device in accordance with the invention when used in combination with a backboard.

Referring to the accompanying drawings wherein like reference numerals refer to the same or similar elements, FIG. 1 is a top view of a flotation device 10 in accordance with the invention when used with a backboard as an example of a rescue apparatus that can be used in accordance with the invention. Flotation device 10 includes a backboard portion 12 and a buoyant structure 14 that is connected to the backboard portion 12 and provides buoyancy to the backboard portion 12, with or without an injured person placed thereon. Alternatively, the flotation device may be considered to comprise only the buoyant structure 14 that is attached to an existing backboard (or other piece of rescue equipment), and not the backboard portion per se. In this case, the flotation device can be designed to connect to multiple and different types of rescue equipment.

Backboard portion 12 may also be considered as a spineboard as this term is understood to those skilled in the art in that it enables a spine of an injured person to be maintained in a straight position and thereby aid in stabilizing the injured person and prevent further damage to the person's spinal cord.

Backboard portion 12 is a generally flat board made from plastic, wood and/or another rigid material, i.e., has substantially planar and parallel upper and lower surfaces. Backboard portion 12 may be a conventional backboard used in aquatic or other environments. In a preferred embodiment, bottom runners, not shown, are formed on the backboard portion 12 or the backboard portion 12 is be formed as a molded-in shape to raise the bottom surface of the backboard portion 12 off of the ground or other horizontal surface, when the backboard is placed thereon. This enables lifeguards or other emergency response personnel to place their hands under the backboard portion 12 for lifting of the flotation device 10 without resulting in the lifeguards or emergency response personnel scraping their hands on the ground or other horizontal surface.

Backboard portion 12 also includes at least one and preferably a plurality of through holes, or hand holds 16 that extend along both lateral sides of the backboard portion 12, as well as along the top and bottom edges of the backboard portion 12. Hand holds 16 serve a dual purpose of enable the lifeguards and emergency response personnel to easily grasp, handle and lift the flotation device 10 as well as to enable use of various types of straps 18 for securing the injured person with a potential neck, back or spinal cord injury to the backboard portion 12. As known in the art, each strap 18 has a buckling and/or tightening and release mechanism 20 to enable the strap to be properly positioned around a person placed on the backboard portion 12 and then secured thereto. Instead of straps 18, other attachment mechanisms and techniques for securing a person to the backboard portion 12 may be applied in accordance with the invention.

Pins, not shown, are optionally provided in conjunction with the hand holds 16 to interact with and better secure the straps 18 to the backboard portion 12. Such pins are known in the art.

The number and positioning of the hand holds 16 and number, positioning and structure of the straps 18 may be varied as desired and these features in the illustrated embodiments do not limit the invention in any manner whatsoever. Thus, the shape of some of the hand holds 16 as elongated through holes does not limit an embodiment of the invention to inclusion of such elongated through holes.

The buoyant structure 14 of the flotation device 10 may have various forms and in the illustrated embodiment comprises a pair of fluid containers 22, each arranged along a respective lateral side of the backboard portion 12. Each fluid container 22 preferably extends along substantially the entire, respective lateral side of the backboard portion 12 to provide an even buoyant force to the backboard portion 12.

However, it is envisioned that the buoyant structure may consist of a frame defining a single fluid-fillable space that surrounds or encircles the backboard portion and provides buoyancy thereto. The frame, when defining either a single fluid-fillable space or a plurality of fluid-fillable spaces, may extend along two, three or more sides of the backboard portion or along the entire circumference of the backboard portion. Alternatively, individual fluid containers may be arranged along the two opposed lateral sides of the backboard portion as shown, or along three or more sides of the backboard portion or along other rescue apparatus. Thus, the flotation device might include four fluid containers, each adapted to be connected to the rescue apparatus at a position alongside a respective edge of the rescue apparatus.

Figure 2:
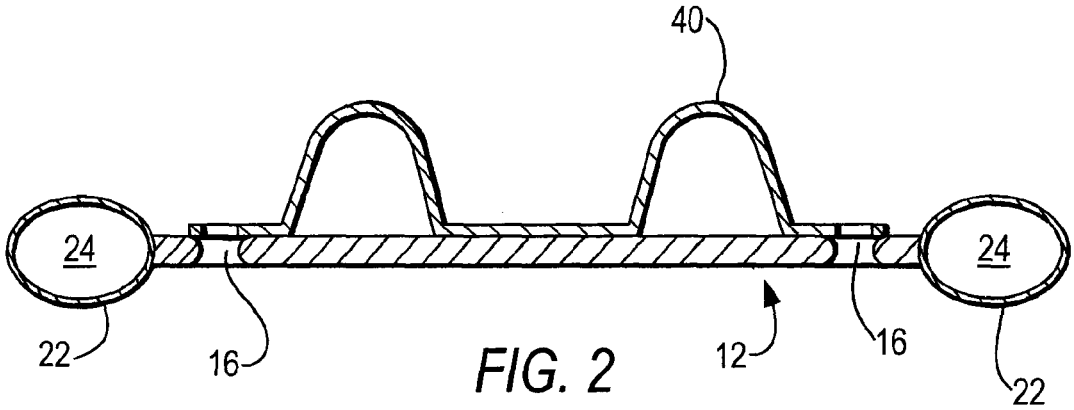
FIG. 2 is a cross-sectional view of the flotation device in accordance with the invention taken along the line 2-2 of FIG. 1.
Figure 3:
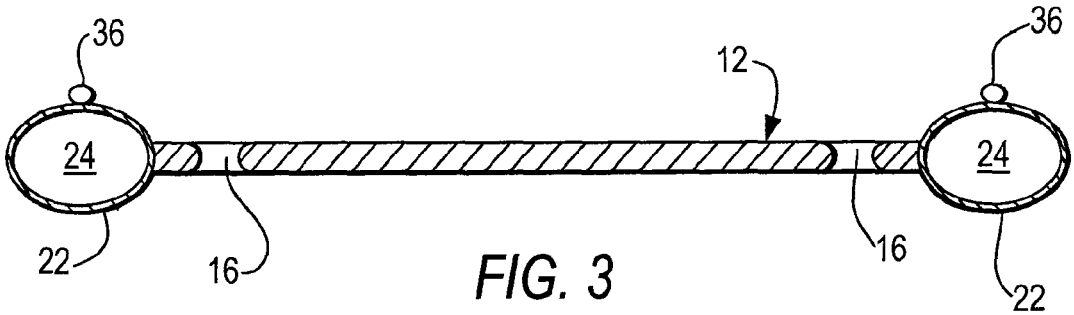
FIG. 3 is a cross-sectional view of the flotation device in accordance with the invention taken along the line 3-3 of FIG. 1.

Each fluid container 22 defines a hollow interior 24 receivable of a lighter than water medium, for example, air, see FIGS. 2 and 3. Fluid containers 22 may be used that each include only a single hollow interior, i.e., a single chamber, or that include a plurality of independent chambers whereby an inflation and/or pressure regulating mechanism, described below, is associated with each such chamber to enable all of the chambers to be inflated and the pressure therein controlled.

An attachment structure 26 attaches the fluid containers 22 to the backboard portion 12 and in the illustrated embodiment, comprises a plurality of straps 28 that each extend through one of the hand holds 16 and a respective grommet 30 arranged in connection with the fluid containers 22. As known in the art, each strap 28 may have a tightening and release mechanism 30 to enable the strap 28 to be properly positioned and adjusted as needed. Aside from straps 28, any other attachment or coupling mechanism or technique that attaches the fluid containers 22 to the backboard portion 12 may be utilized in accordance with the invention.

In the embodiment shown in FIG. 1, the straps 28 have hook and loop fasteners, e.g., of Velcro®. Some of the straps 28 may also be used to hold the fluid containers 22 in an accordion-pleated state for storage. On the other hand, in the embodiment shown in FIG. 4, the fluid containers 22 are not provided with grommets and different straps 28A are provided, each strap 28A extending around a fluid container 22 and through one of the hand holds 16. As known in the art, each strap 28A may have a tightening and release mechanism to enable the strap 28A to be properly positioned and adjusted as needed.

To regulate the buoyancy of the fluid containers 22 and thus the buoyancy provided by the buoyant structure 14 to the backboard portion 12 especially when the injured person is placed thereon, a variety of pressure regulating mechanisms may be connected to each fluid container 22. These pressure regulating mechanisms may be integrated into or onto the surface of the fluid containers 22.

Figure 4:
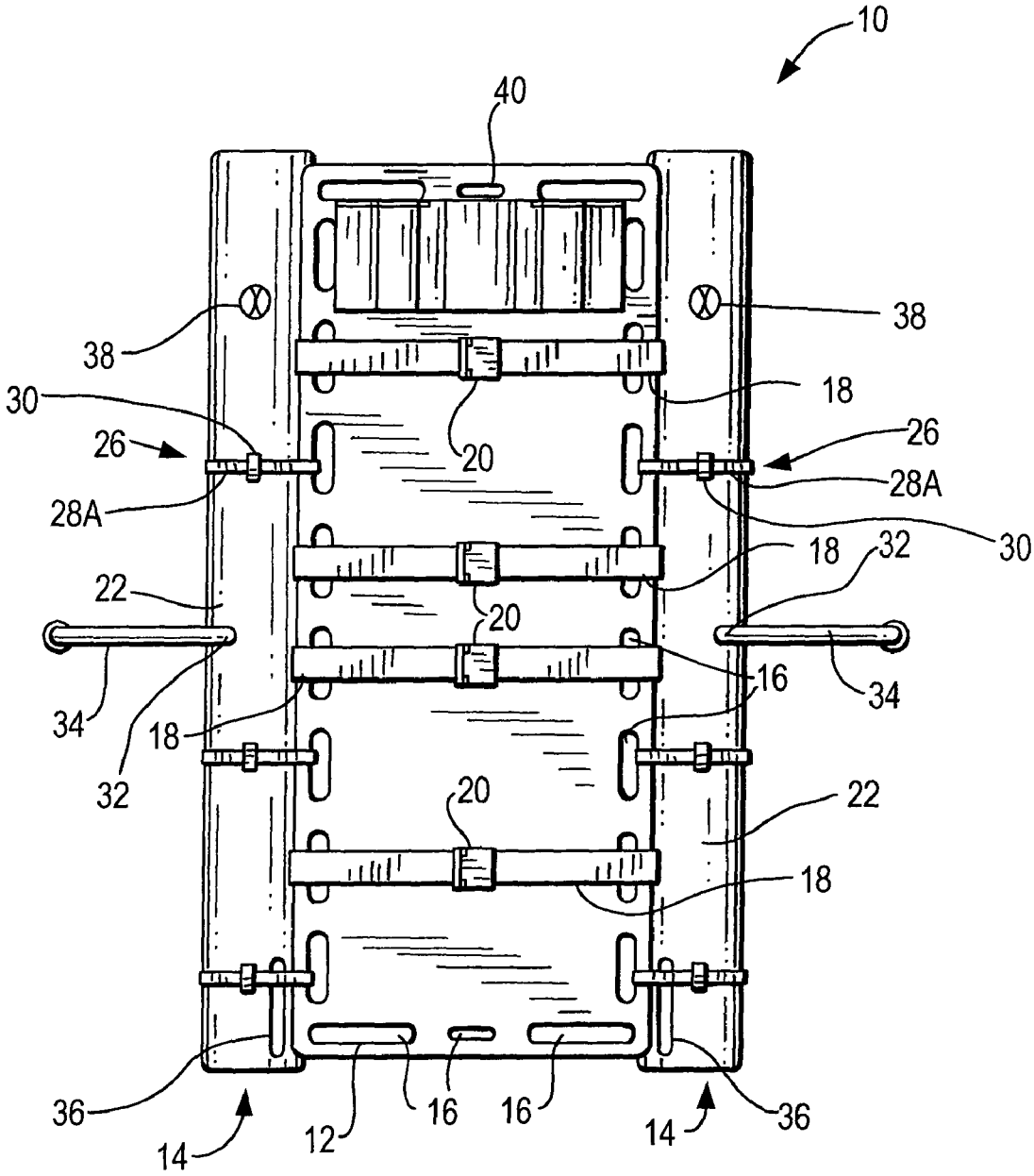
FIG. 4 is a top view of a second embodiment of a flotation device in accordance with the invention when used in combination with a backboard.

For introducing fluid into the hollow space 24 of the fluid container 22, there is at least one inflation mechanism which may be a manual inflation valve 32 to enable air to be introduced into the hollow space 24 by, for example, a lifeguard blowing into an associated inflation tube 34. The manual inflation valve 32 and inflation tube 34 may be an integral component, e.g., the inflation tube 34 is a long mouthpiece extension with the manual inflation valve 32 arranged internally therein. Blowing through an end of the inflation tube 34 causes air to pass through the internal inflation valve 32 into the interior of the hollow space 24 of the fluid container 22. The inflation tube 34 may have a variable length. As shown in FIGS. 1 and 4, the inflation tube 34 is connected to a middle portion of each fluid container 22, but its position can vary as desired.

Additionally or alternatively, there may be a $CO_2$ cartridge, or cartridge of another pressurized gas, and associated releasing mechanism 36 that is activated to cause inflation of fluid container 22 by releasing pressurized gas therein. Any type of inflation mechanism may be used whether operating via manual inflation, through an inflation tube, or semi-automatically, or automatically by a special gas cartridge releasing mechanism, with the objective of the inflation mechanism being to inflate the fluid container 22 to enable the backboard portion 12 to float.

An automatic inflation mechanism may be a gas release mechanism that monitors the pressure in the interior space 24 of the fluid container 22 and injects gas whenever the pressure falls below a threshold.

Buoyancy of the flotation device 10 when an injured person is placed thereon is thereby provided which facilitates rescue of an injured person by stabilizing the backboard portion 12 so that the injured person can remain stable, balanced and safe while being attended to by lifeguards or emergency personnel.

In addition, the level of buoyancy for the flotation device 10 may be adjusted by additional release of gas or other fluid from the releasing mechanism 36 or manual inflation via the inflation tube 34 to thereby enable precision in the degree of buoyancy needed for a particular injured person in a particular situation. That is, a heavier person may require additional inflation whereas a lighter person would not and the invention enables this variability in the buoyancy by providing the lifeguards or other emergency personnel with the easy ability to quickly further inflate the fluid containers 22 and thereby increase the buoyancy of the flotation device 10.

Moreover, a manually or automatically controlled deflation or pressure release mechanism, e.g., a dump valve 38, is arranged in fluid connection with the hollow interior 24 of each fluid container 22 to further enable variability in the buoyancy of the flotation device 10. Activation of dump valve 38 would bleed air or other fluid from the hollow space 24 in the fluid container 22 and thereby reduce the buoyancy of the flotation device 10. All of the fluid in the hollow space 24 may be bled therefrom when the flotation device 10 is being prepared for shipment and/or storage. An automatic pressure release valve may be provided that monitors the pressure in the interior space 24 of the fluid container 22 and opens a valve to the ambient atmosphere whenever the pressure is higher than a threshold. Thus, various types of manual pressure release mechanisms and automatic pressure release mechanisms are envisioned for use in the invention.

Adjustment over the level of buoyancy permits rescuers to adjust the buoyancy needed for a particular injured person's size, e.g., weight as mentioned above, and the conditions in which the rescue is taking place. Thus, the rescuers would be trained how to adjust buoyancy of the flotation device 10, e.g., inflation via the manual inflation tube 34 and the releasing mechanism 36 and deflation via dump valve 38, relative to an injured person's size as well as the conditions in which the injured person is located. As mentioned above, these conditions include the depth of the water that the injured person is located in, additional water conditions such as temperature, movement and surface conditions, the number of lifeguards on duty, and the type of equipment available to handle the specific potential injury.

Control over the buoyancy of the flotation device 10 assists rescuers by offering support of the injured person on the backboard portion 12 to the rescuers thereby minimizing the rescuers' fatigue and making it easier for the rescuers to perform any necessary tasks required to secure the injured person to the backboard portion 12 and move the injured person thus-secured through water to dry land. It is even possible to adjust the buoyancy of the flotation device 10 relative to changing conditions after the injured person is placed onto the backboard portion 12, e.g., more rescuers arrive, and the depth of the water and/or wave height has changed.

Additional parts of the flotation device 10 may include "D" rings for aiding in lifting the flotation device 10 or for tying down the injured person, carry handles, a head and neck support 40, reflective materials, sea anchors, strobe lights, GPS positioning systems, bottom runners, and tie-down strap keepers, Tie-down strap keepers would keep the tie-down straps, used to secure a body to the backboard portion 12, neatly stowed and prevent entanglement when rescuers are positioning the body on the backboard portion 12.

The flotation device 10 is preferably constructed to shed water and be water tight, so as not to become too heavy during use and transport.

The flotation device 10, when added to an existing backboard or other similar piece of rescue equipment, provides a significant advantage over a standard backboard, when used in an aquatic environment, in that it is simple to manufacture and use, rugged and provides improved stability for injured person. Moreover, the flotation device 10 can be used in any aquatic or marine environment as well as in other types of emergencies where quick deployment of a stable, buoyant platform is necessary, such as in ice rescues.

In use, the buoyant structure 14 is pre-attached to the backboard portion 12, e.g., by straps 28, to form the flotation device 10, and would be stored in this condition. When needed to stabilize an injured person in a body of water, it would be brought to the water by a rescuer and the injured person secured to the backboard portion 12 by straps 18. The rescuer would initiate an inflation phase of the fluid containers 22 by, for example, activating the $CO_2$ gas cartridge release mechanism 36 associated with each fluid container 22 for a set period of time so that gas would be released and fill the hollow space 24 in each fluid container 22. The rescuer would then regulate the buoyancy of the flotation device 10, if necessary, by further activating the $CO_2$ gas cartridge release mechanism 36, blowing into the manual inflation tube 34, and/or releasing gas via dump valve 38. This regulation is designed to optimally support the injured person based on their size and the surrounding rescue conditions, as mentioned above.

In some type of emergencies, such as ice rescue emergencies, the fluid containers 22 may be pre-inflated and the flotation device 10 brought to a site of a rescue in this condition.

Having described exemplary embodiments of the invention with reference to the accompanying drawings, it will be appreciated that the present invention is not limited to those embodiments, and that various changes and modifications can be effected therein by one of ordinary skill in the art without departing from the scope or spirit of the invention as defined by the appended claims. For example, although described for use with a backboard, the buoyant structure may be used with other types of rescue apparatus or equipment for which application in an aquatic environment would be beneficial or useful, such as a Stokes Basket. The buoyant structure would be used in substantially the same manner, e.g., attached by straps or another attachment structure to the rescue apparatus and inflated for use with the inflation pressure being controlled in dependency on the characteristics of the person being rescued.

The invention claimed is:

1. A flotation device for a rescue apparatus, comprising:

a support portion onto which an injured person is placed; and a buoyant structure connected to said support portion to provide buoyancy for said support portion, wherein said buoyant structure comprises a pair of fluid containers, each of said containers defining at least one hollow space, wherein said buoyant structure further comprises at least one pressure regulating mechanism adapted to regulate pressure of fluid in said at least one hollow space of said containers, wherein said at least one pressure regulating mechanism comprises an inflation mechanism that enables controlled inflow of fluid into said hollow space of said respective container and a deflation mechanism that enables controlled outflow of fluid from said hollow space of said respective container, and wherein said at least one pressure regulating mechanism further comprises a dump valve that enables controlled outflow of fluid from said hollow space of said respective container.

2. The flotation device of claim 1, wherein the support portion is a backboard portion comprising a flat board onto which an injured person is placed.

3. The flotation device of claim 1, further comprising an attachment system that attaches said buoyant structure to said support portion.

4. The flotation device of claim 3, wherein said attachment system comprises a plurality of straps that each extend around or through a portion of said buoyant structure and through an aperture in said support portion.

5. The flotation device of claim 1, wherein said buoyant structure defines at least one hollow, fluid-fillable space.

6. The flotation device of claim 1, wherein each of said containers being arranged along a respective lateral side of said support portion, each of said containers defining at least one hollow space on said lateral side of said support portion.

7. The flotation device of claim 6, wherein said containers are separate from one another, each of said containers defining only a single hollow space and extending along substantially the entire respective lateral side of said support portion.

8. The flotation device of claim 6, further comprising an attachment system that attaches said containers to said support portion.

9. The flotation device of claim 8, wherein said buoyant structure comprises grommets and said attachment system comprises a plurality of straps that each extend through a respective one of said grommets and through an aperture in said support portion.

10. The flotation device of claim 8, wherein said attachment system comprises a plurality of straps that each extend around one of said containers and through an aperture in said support portion.

11. The flotation device of claim 1, wherein said support portion has a plurality of sides, said buoyant structure defining hollow spaces on at least two opposed ones of said sides of said support portion.

12. The flotation device of claim 1, wherein said at least one pressure regulating mechanism is integrated into or onto a surface of each of said containers.

13. The flotation device of claim 1, wherein said inflation mechanism further comprises a manual inflation valve and an associated manual inflation tube.

14. The flotation device of claim 1, wherein said inflation mechanism comprises a pressurized gas cartridge and associated activatable releasing mechanism.

15. A flotation device comprising:

a backboard comprising a flat board onto which an injured person is placed, a buoyant structure defining at least one hollow, fluid-fillable space; and an attachment system that attaches said buoyant structure to the backboard, wherein said buoyant structure comprises at least one fluid container defining a hollow, fluid-fillable space and having first connectors arranged in connection therewith, said attachment system comprising a plurality of second connectors that each engage a respective one of said first connectors and said backboard, said flotation device further comprising at least one pressure regulating mechanism operably fluidly coupled to each of said at least one container, each of said at least one pressure regulating mechanism varying pressure of fluid in a hollow space of a respective one of said at least one container, said at least one pressure regulating mechanism comprising an inflation mechanism that enables controlled inflow of fluid into said hollow space of said respective container and a deflation mechanism that enables controlled outflow of fluid from said hollow space of said respective container.

* * * * *